US006511369B2

(12) United States Patent
Chi

(10) Patent No.: US 6,511,369 B2
(45) Date of Patent: Jan. 28, 2003

(54) GRINDING WHEEL REPLACEMENT SAFETY STRUCTURE FOR HANDHELD GRINDING WHEEL DEVICE

(75) Inventor: Wen Yao Chi, Feng Yuan (TW)

(73) Assignee: Mobiletron Electronics Co., Ltd., Taichung Hsien (TW)

( * ) Notice: Subject to any disclaimer, the term of this patent is extended or adjusted under 35 U.S.C. 154(b) by 5 days.

(21) Appl. No.: 09/795,147

(22) Filed: Mar. 1, 2001

(65) Prior Publication Data

US 2002/0123301 A1 Sep. 5, 2002

(51) Int. Cl.[7] ..... B24B 23/00

(52) U.S. Cl. ..... 451/344; 451/342; 451/353; 451/358; 451/359; 451/363

(58) Field of Search ..... 451/342, 358, 451/353, 363, 359, 344

(56) References Cited

U.S. PATENT DOCUMENTS 3,899,852 A * 8/1975 Batson ..... 451/359
4,434,586 A * 3/1984 Muller et al. ..... 451/342
5,022,188 A * 6/1991 Borst ..... 451/342
5,157,873 A * 10/1992 Rudolf et al. ..... 279/904
5,466,183 A * 11/1995 Kirn et al. ..... 173/170
5,601,483 A * 2/1997 Rudolf et al. ..... 451/342
5,718,621 A * 2/1998 Turley ..... 451/342

* cited by examiner

*Primary Examiner*—Joseph J. Hail, III
*Assistant Examiner*—David Nguyen
(74) *Attorney, Agent, or Firm*—Rosenberg, Klein & Lee

(57) ABSTRACT

A grinding wheel replacement safety structure for handheld grinding wheel device is located between a transmission grinding wheel fitting end and an actuating push button, and includes a safety button, a stop in, a limit actuating link, a link spring, and a stop in spring. The safety button is located above an umbrella-shaped gear of the fitting end and has a button face projecting from a grinding wheel housing. The stop pin extends vertically across a rear end of the button face proximate to a hub of the gear. The limit actuating link extends transversely across an offset surrounding wall of the safety button proximate to the actuating push button. The link spring is fitted over the limit actuating link and the stop pin spring is fitted over a neck portion of the stop pin to respectively abut against the inner wall of the housing. When the safety button is turned, the stop pin is retained on the hub of the gear, while the limit actuating link abuts against the actuating push button to lock the fitting end and stop movement of the actuating push button, thereby facilitating replacement of the grinding wheel and ensuring safety.

2 Claims, 3 Drawing Sheets

GRINDING WHEEL REPLACEMENT SAFETY STRUCTURE FOR HANDHELD GRINDING WHEEL DEVICE

BACKGROUND OF THE INVENTION (a) Field of the Invention

The present invention relates to a grinding wheel replacement safety structure for handheld grinding wheel device.

(b) Description of the Prior Art

Handy handheld grinding wheel devices that are used on-site to remove burrs or polishing are commonly used electric hand tools. For different grinding operations, they are used in conjunction with different types of grinding wheels. Besides, the grinding wheels have to be replaced after being used for some time. As such, replacement of grinding wheels is necessary.

However, a conventional handheld grinding wheel device is not equipped with any safety structure to lock the grinding wheel or the actuating push button to ensure safety during replacement.

SUMMARY OF THE INVENTION

The present invention relates to a grinding wheel replacement safety structure for handheld grinding wheel device.

Therefore, the object of the present invention is to provide a grinding wheel replacement safety structure for handheld grinding wheel device that can lock a grinding wheel fitting end and prevent movement of an actuating push button during replacement of grinding wheels to thereby overcome the drawbacks with the prior art.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
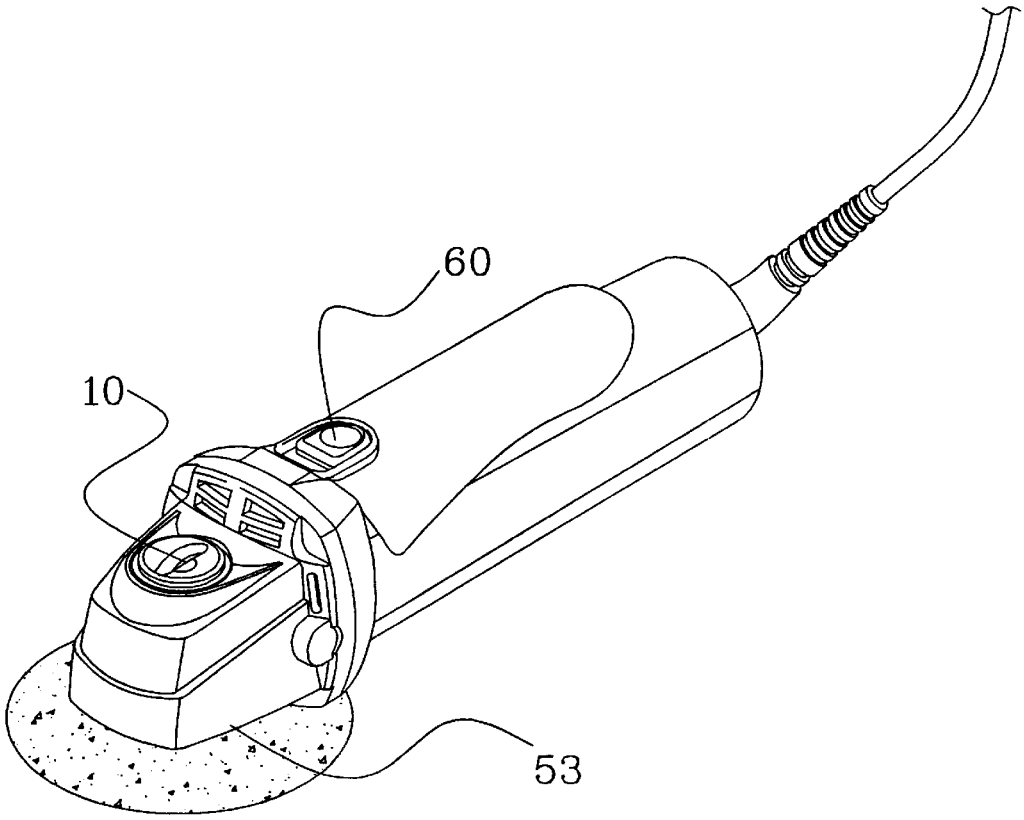
FIG. 1 is a perspective view of the preferred embodiment of a grinding wheel replacement safety structure for handheld grinding wheel device according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 2:
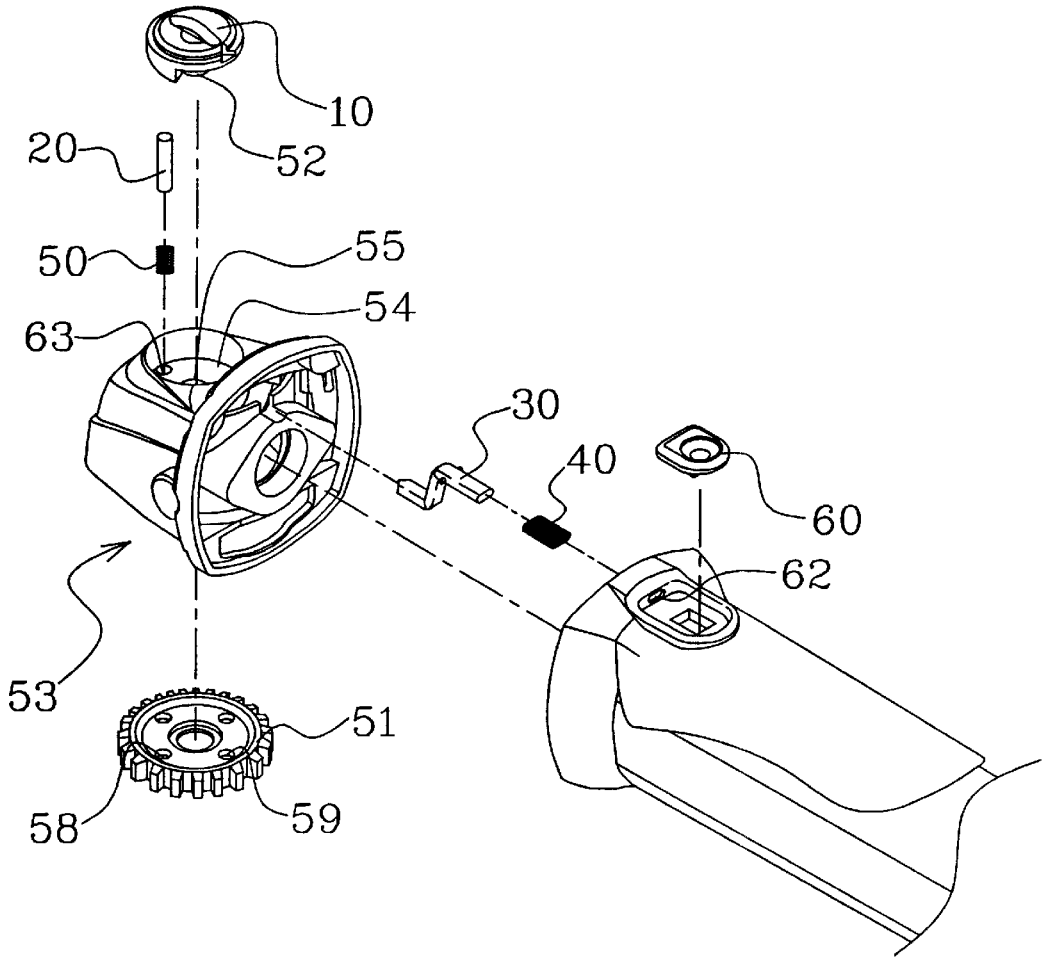
FIG. 2 is an exploded perspective view of the preferred embodiment of FIG. 1.

FIG. 1 shows a perspective view of the preferred embodiment of a grinding wheel replacement safety structure for a handheld grinding wheel device according to the present invention. With further reference to FIG. 2, the grinding wheel replacement safety structure for a handheld grinding wheel is provided on a handheld grinding wheel housing and disposed between a transmission grinding wheel fitting end 53 and an actuating push button 60, comprising: a safety button 10, a stop pin 20, a limit actuating link 30, a link spring 40, and a stop pin spring 50. The safety button 10 is located above an umbrella-shaped gear 51 of the fitting end 53, with a button face projecting from the grinding wheel housing to engage an insert hole 55 formed in the center of a button receiving space 54 provided on the housing. An inverted oblique push face is formed around the rear end of the button face. The stop pin 20 is vertically disposed at a suitable position to be connected therewith, and passes through a vertical through hole 63 in the housing. The pin 20 laps the other end of the button 10 near the hub of the gear 51. The hub of the gear 51 is provided with a plurality of retaining grooves 58, 59 for receiving and locking the end of the stop pin 20. The limit actuating link 30 extends transversely across the offset surrounding wall surface of the safety button 10 and through a transverse through hole 62 in a corresponding position of the housing. The link 30 laps the other end of the surrounding wall of the button 10 proximate to the actuating push button 60. The limit actuating link 30 is fitted with the link spring 40, and the neck portion of the stop pin 20 is fitted with the stop pin spring 50 to respectively abut against the inner wall of the grinding wheel housing.

Figure 3:
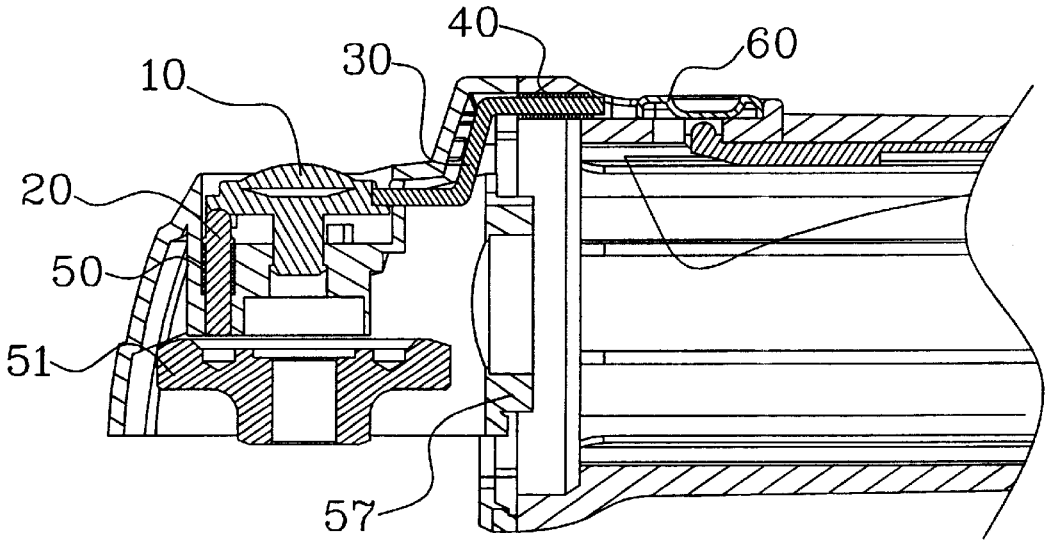
FIG. 3 is a sectional view of FIG. 1 showing the grinding wheel in a state of use.

When it is desired to use the grinding wheel without replacing the grinding wheel, as shown in FIG. 3, the safety button 10 is turned so that the rear end of the button 10 does not push the stop pin 20. The stop pin 20, due to biasing action of the pin spring 50, disengages the gear 51. At the same time, the surrounding wall of the safety button 10 does not push the limit actuating link 30 so that the link 30, due to the biasing action of the link spring 40, moves out of the push clearance of the actuating push button 60 to permit triggering of the actuating push button 60 so that a pull rod at the lower end of the button 60 is pressed to connect to power, whereby a gear box 57 in the housing drives the gear 51 to rotate the grinding wheel (not shown) connected tot he gear 51 for grinding purposes.

Figure 4:
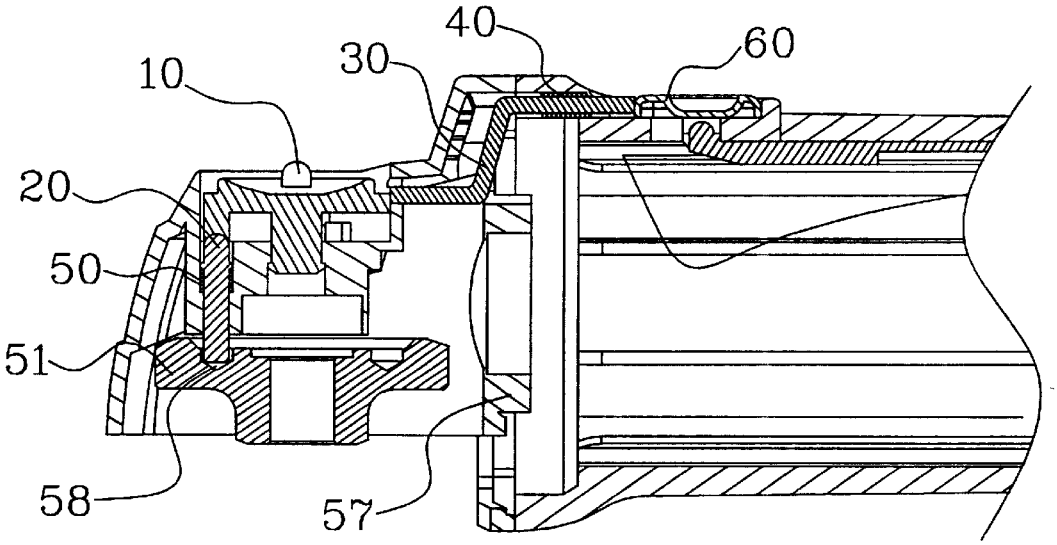
FIG. 4 is a sectional view of FIG. 1 showing the preferred embodiment in a state for grinding wheel replacement.

When replacement of the grinding wheel is desired, as shown in FIG. 4, the safety button 10 is turned so that the rear end of the button pushes the stop pin 20 to compress the spring 50 and engages the any one of the retaining grooves (58 or 59) on the gear 51 to lock the connecting end of the grinding wheel to prevent it from rotating, thereby achieving the object of facilitated replacement of the grinding wheel (not shown). At the same time, the surrounding wall of the safety button 10 pushes the limit actuating link 30 during turning thereof, so that the link 30 presses the link spring 40 to extend to abut against the actuating push button 60 to fill the push clearance. Hence, the actuating push button 60 cannot be pushed to connect to electricity. The stop pin 20 brakes idle rotation of the gear 51 to facilitate replacement of the grinding wheel. During the process of replacement, even if the actuating push button 60 is touched inadvertently, the actuating push button 60 cannot be pushed to rotate the grinding wheel to create any danger to the operator or damage to the motor or gear, thereby ensuring safety.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A safety structure for a handheld grinding tool having a fitting end and an actuating push button, comprising:

a safety button rotatably mounted on the fitting end, said safety button having a button face projecting into the fitting end;

a gear disposed in the fitting end and having a plurality of retaining grooves formed therein;

a limit actuating link biased toward a perimeter portion of said safety button by a link spring disposed thereon, said safety button communicating with the actuating push button through said limit actuating link for preventing operation of said actuating push button responsive to selective rotation of said safety button; and, a stop pin biased by a stop pin spring to contact said safety button with a first end thereof, said stop pin being displaceable responsive to said selective rotation of said safety button to engage a corresponding one of said retaining grooves with a second end thereof, wherein said gear is blocked from rotation simultaneously with the actuating push button being blocked from actuation of the handheld grinding tool.

2. An electric hand tool device, comprising:

a hand tool housing;

an actuating push button mounted on said hand tool housing for actuating the electric hand tool device;

a fitting end coupled to said hand tool housing;

a safety button rotatably mounted on said fitting end;

a gear disposed in said fitting end and having a plurality of retaining grooves formed therein;

a limit actuating link biased toward a perimeter portion of said safety button by a link spring disposed thereon, said safety button communicating with said actuating push button through said limit actuating link for preventing operation of said actuating push button responsive to selective rotation of said safety button; and, a stop pin having a stop pin spring disposed thereon to bias a first end of said stop pin into contact with said safety button, said stop pin being displaceable to engage a corresponding one of said retaining grooves with a second end thereof and block said gear against rotation responsive to said selective rotation of said safety button.

* * * * *